US011802444B2

(12) United States Patent
Pelfrene et al.

(10) Patent No.: US 11,802,444 B2
(45) Date of Patent: Oct. 31, 2023

(54) DRILL BIT HAVING A WEIGHT ON BIT REDUCING EFFECT

(71) Applicant: Varel Europe S.A.S., Pau (FR)

(72) Inventors: Gilles Pelfrene, Fontainebleau (FR); Alfazazi Dourfaye, Paris (FR)

(73) Assignee: Varel Europe S.A.S., Nousty (FR)

( * ) Notice: Subject to any disclaimer, the term of this patent is extended or adjusted under 35 U.S.C. 154(b) by 59 days.

(21) Appl. No.: 17/609,120

(22) PCT Filed: Jun. 22, 2020

(86) PCT No.: PCT/IB2020/055853
§ 371 (c)(1),
(2) Date: Nov. 5, 2021

(87) PCT Pub. No.: WO2020/261085
PCT Pub. Date: Dec. 30, 2020

(65) Prior Publication Data

US 2022/0220809 A1 Jul. 14, 2022

(30) Foreign Application Priority Data

Jun. 25, 2019 (EP) ..... 19315048

(51) Int. Cl.
*E21B 10/43* (2006.01)
*E21B 10/55* (2006.01)

(52) U.S. Cl.
CPC ..... *E21B 10/43* (2013.01); *E21B 10/55* (2013.01)

(58) Field of Classification Search
CPC ..... E21B 10/43; E21B 10/55; E21B 10/54; E21B 10/42; E21B 10/46
See application file for complete search history.

(56) References Cited

U.S. PATENT DOCUMENTS 5,649,604 A 7/1997 Fuller
6,164,394 A 12/2000 Mensa-Wilmot
(Continued)

FOREIGN PATENT DOCUMENTS

CA 3 021 278 A1 5/2019
CA 3021278 A1 * 5/2019 ..... E21B 10/43
GB 2317632 A * 4/1998 ..... E21B 10/43

OTHER PUBLICATIONS

SPE 10152, Huang et al, "The Positive Effects of Side Rake in Oilfield Bits Using Polycrystalline Diamond Compact Cutters" (1981).

(Continued)

*Primary Examiner* — Caroline N Butcher

(57) ABSTRACT

A bit for drilling a wellbore includes: a body; and a cutting face. The cutting face includes: an inner section and an outer section; a plurality of blades protruding from the body, and a row of superhard cutters mounted along each blade, the cutters in the inner section having a negative profile angle and the cutters in the outer section having a positive profile angle. At least one of: at least one inner cutter is oriented at a negative side rake angle to create a weight on bit (WOB) reducing effect, and at least one outer cutter is oriented at a positive side rake angle to create the WOB reducing effect. Each of the rest of the cutters are oriented at a side rake angle such that an overall effect of the side rake angles is the WOB reducing effect.

19 Claims, 8 Drawing Sheets

(56) References Cited

U.S. PATENT DOCUMENTS

| | | | | |
|---|---|---|---|---|
| 7,059,431 | B2 | 6/2006 | Simon | |
| 7,441,612 | B2 | 10/2008 | Durairajan | |
| 9,556,683 | B2 | 1/2017 | Simmons | |
| 11,008,814 | B2 | 5/2021 | Silveus, III | |
| 2012/0111630 | A1 | 5/2012 | Chen | |
| 2012/0205163 | A1* | 8/2012 | Azar | E21B 10/46 175/428 |
| 2019/0017328 | A1 | 1/2019 | Reese | |
| 2020/0011137 | A1 | 1/2020 | Maurstad | |

OTHER PUBLICATIONS

IADC/SPE 151406, Rajabov et al, "The Effects of Back Rake and Side Rake Angles on Mechanical Specific Energy of Single PDC Cutters with Selected Rocks at Varying Depth of Cuts and Confining Pressures" (2012).

EPO Search Report and Opinion for Application No. 19 315 048.9 dated Dec. 4, 2019.

GCC Examination Report for Application No. GC 2020-39983 dated Sep. 3, 2021.

Response to Office Action dated May 22, 2019 for U.S. Appl. No. 16/161,661, filed Jul. 3, 2019.

EPO Opinion for Application No. 19 315 048.9 dated Oct. 6, 2021.

* cited by examiner

| | WOB (kN) | TOB (kN*m) |
|---|---|---|
| Reference | 87.2 | 6.9 |
| Emb. 1b | 61.8 | 7.1 |
| Emb. 1c | 79.6 | 6.8 |
FIG. 4A
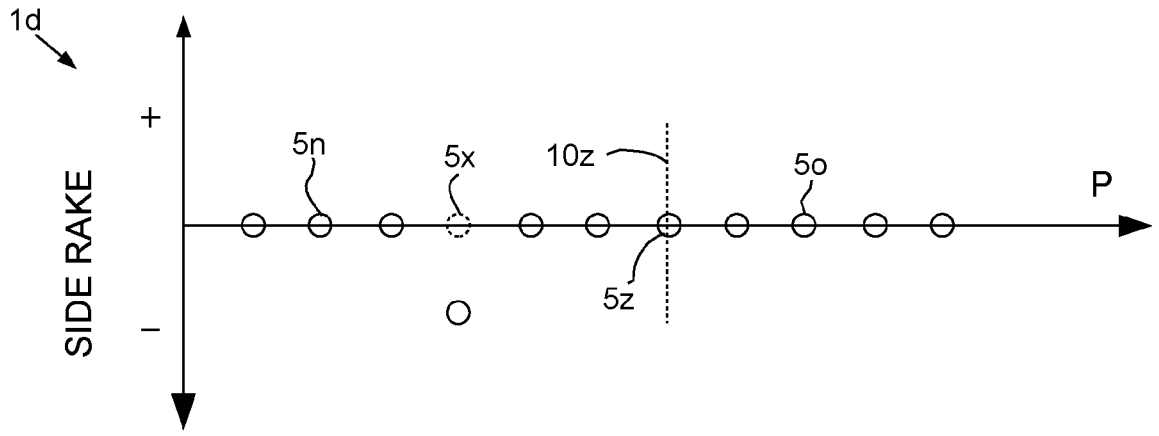
FIG. 4B
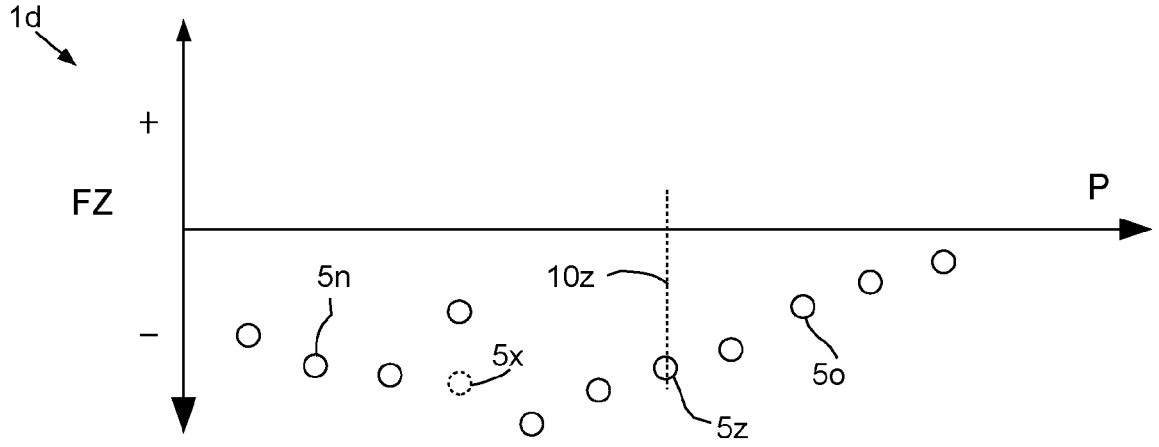
FIG. 4C

| | WOB (kN) | TOB (kN*m) |
|---|---|---|
| Reference | 86.7 | 6.9 |
| Emb. 12 | 69.8 | 7.3 |
FIG. 8A
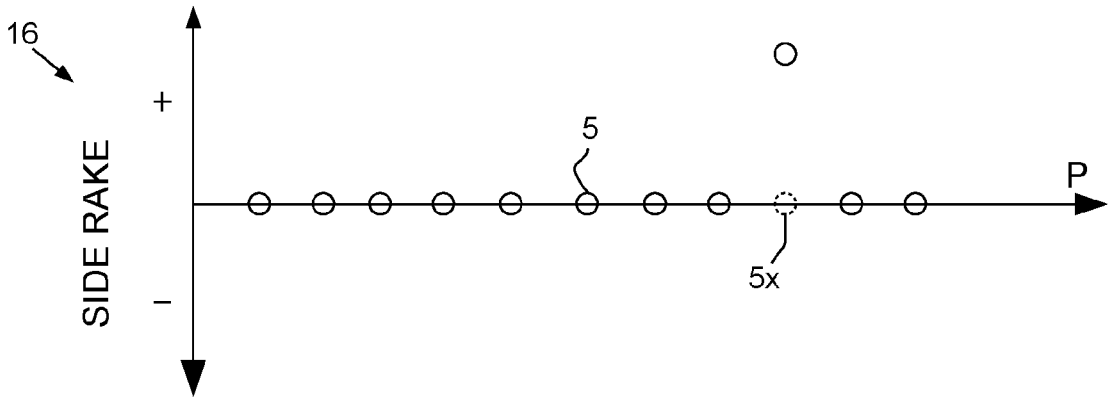
FIG. 8B
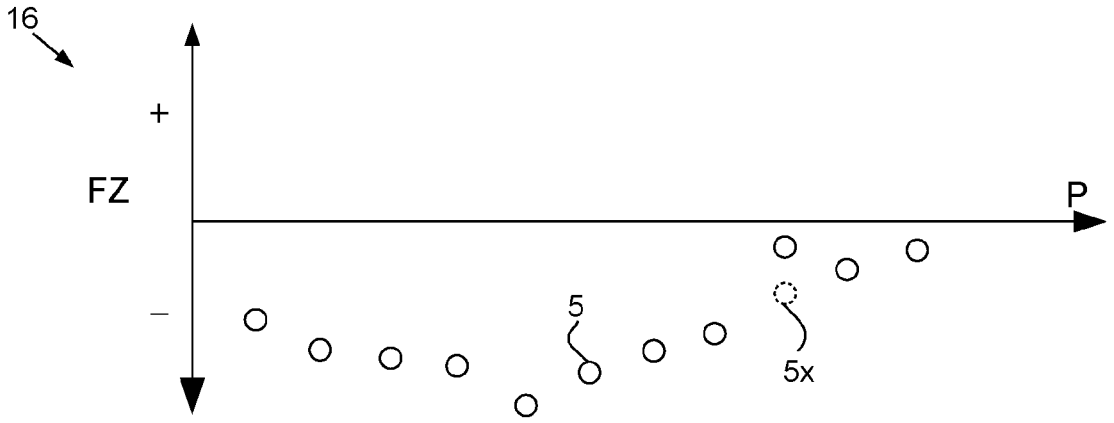
FIG. 8C

DRILL BIT HAVING A WEIGHT ON BIT REDUCING EFFECT

BACKGROUND OF THE DISCLOSURE

Field of the Disclosure

The present disclosure generally relates to a drill bit having a weight on bit (WOB) reducing effect.

Description of the Related Art

SPE-10152-MS discloses, what used to be considered a novel drilling technique, the use of synthetic diamond cutters in a drag bit configuration, has now emerged in the drilling industry as a time and cost efficient drilling tool. These bits, utilizing polycrystalline diamond compact cutters for drilling polycrystalline diamond compact cutters for drilling soft or plastic formations have been proven successful through a systematic development. First, the main problem associated with drilling soft or plastic formations was identified as bit cleaning. Second, laboratory tests of a single compact cutting plastic shale under confining pressure with a load dynamometer and high speed photography were studied. The results demonstrated that a compact incorporating side rake angle and ample chip clearance space can provide efficient mechanical cleaning action. Finally, new style drill and core bits, built with side rake orientation along with previous style drill and core bits without side rake features, were field tested and observed in the same drill hole or in the same formation. The drill or core bits with side rake features always drilled or cored faster in the soft or plastic formations than those bits without side rake under the same operating parameters (hydraulic, bit weight and rpm). It was concluded that bits with side rake features can enhance the bit cleaning by mechanical cleaning action and, therefore, improve the bit performance in soft or plastic formations.

SPE-151406-MS discloses one of the key objectives within the drilling industry is optimizing rate of penetration (ROP) and a major contributor to obtaining this objective is the PDC bit design. Whilst previous papers have proven that the PDC cutting structure geometry, particularly back rake and side rake angles, affect PDC bit performance when tested at atmospheric conditions, no information in the SPE literature exists for similar tests at confining pressures. The effect of side rake angle on cutter aggresiveness and cutter interaction at depths of cut (DOC) in excess of 0.04 inch are particularly unknown under confined pressure. The results of more than 150 tests show that back rake and side rake angles have substantial effects on Mechanical Specific Energy (MSE) and the aggressiveness of PDC cutters. Experiments with three different rock types; Carthage marble, Mancos shale, and Torrey Buff sandstone, revealed that at both atmospheric and elevated confining pressures, PDC cutters with 10 deg back rake angles require half the energy to cut the same volume of rock and produce higher cutting efficiency compared with cutters having 40 deg back rake angles. Possible reasons for this behavior are explained through the analysis of the cutting process. Results show that a cutter with low back rake requires less horizontal cutting force in order to cut the same volume of rock. This observation indicates that not only will a PDC bit with lower back rake angles, drill more efficiently, but it will also require less torque in order to drill at the same ROP. Other factors such as reduced durability of cutters at low back rake angles should also be considered while applying these results to PDC bit designs. Test results at both atmospheric and confining pressures revealed that MSE decreases with increasing DOC up to 0.08 inch on all three rock types. However, the tests also showed that MSE starts to increase slightly at DOCs above 0.08 inch, possibly suggesting an optimal minimum DOC. Experimental results also show that, whilst Mancos shale and Carthage marble have about the same compressive strength, Mancos shale requires three times less energy to cut compared to Carthage marble. This indicates that, compressive strength of some rocks such as shales cannot be used alone as a reference rock property for accurately evaluating and comparing drilling efficiency. A new 3D mechanistic PDC cutter-rock interaction model was also developed which incorporates the effects of both back rake and side rake angles, along with rock specific coefficient of friction. The results from this single-cutter model are encouraging as they are consistent with the experimental data.

U.S. Pat. No. 5,649,604 discloses a rotary drill bit including a bit body having a shank for connection to a drill string, a plurality of cutters mounted on the bit body, each cutter having a cutting face, and means for supplying drilling fluid to the surface of the bit body to cool and clean the cutters. At least some of the cutters are lateral cutters located to act sideways on the formation being drilled, and the cutting faces of such lateral cutters are orientated to exhibit negative side rake and negative top rake with respect to the surface of the formation. The negative side rake angle is greater than 20° and may be as much as 90°, and the negative top rake angle is also more than 20°. A single cutter may include two cutting faces at different negative side rake angles, e.g. the cutter may comprise a generally cylindrical substrate formed at one end with two oppositely inclined surfaces meeting along a ridge, a facing table of polycrystalline diamond being bonded to the substrate surfaces and extending over the ridge.

U.S. Pat. No. 7,059,431 discloses a self-penetrating drilling method and a thrust-generating tool: the tool comprises N blades. Each blade comprised K drill cutters. The shapes, positions and orientations of said drill cutters are determined in the following manner: the kth drill cutter of the last blade drills, at the $(q-1)^{th}$ of the tool rotational cycle, a cut in the rock downstream of the one produced by the $(k+1)^{th}$ drill cutter of the first blade at the $q^{th}$ rotational cycle of the tool; the kth drill cutter of the nth blade drills, at the $q^{th}$ rotational cycle of the tool, a cut in the rock downstream of the one produced by the kth drill cutter of the $(n+1)^{th}$ blade at the $q^{th}$ rotational cycle of the tool; the normal to the leading edge of the drill cutter has a component along the axis of rotation oriented towards upstream.

U.S. Pat. No. 7,441,612 discloses a fixed cutter drill bit and a method for designing a fixed cutter drill bit including simulating the fixed cutter drill bit drilling in an earth formation. A performance characteristic of the simulated fixed cutter drill bit is determined. A side rake angle distribution of the cutters is adjusted at least along a cone region of a blade of the fixed cutter drill bit to change the performance characteristic of the fixed cutter drill bit.

U.S. Pat. No. 9,556,683 discloses earth boring tools with a plurality of fixed cutters having side rake or lateral rakes configured for improving chip removal and evacuation, drilling efficiency, and/or depth of cut management as compared with conventional arrangements.

US 2019/0017328 discloses a drill bit mounted on or integral to a mandrel on the distal end of a downhole motor directional assembly. The drill bit is in a fixed circumferential relationship with the activating mechanism of one or more dynamic lateral pads (DLP). The technologies of the present application assist in and optionally control the extent of lateral movement of the drill bit. The technologies include, among other things, the placement and angulation of the cutting structures in the cone areas of the blades on the drill bit.

SUMMARY OF THE DISCLOSURE

The present disclosure generally relates to a drill bit having a weight on bit (WOB) reducing effect. In one embodiment, a bit for drilling a wellbore includes: a body; and a cutting face. The cutting face includes: an inner section and an outer section; a plurality of blades protruding from the body, each blade extending from a center of the cutting face and across the outer section; and a row of superhard cutters mounted along each blade, each cutter mounted in a pocket formed adjacent to a leading edge of the blade, the cutters in the inner section having a negative profile angle and the cutters in the outer section having a positive profile angle. At least one of: at least one inner cutter is oriented at a negative side rake angle to create a weight on bit (WOB) reducing effect relative to a hypothetical cutter oriented at a zero side rake angle, and at least one outer cutter is oriented at a positive side rake angle to create the WOB reducing effect. Each of the rest of the cutters are oriented at a side rake angle such that an overall effect of the side rake angles is the WOB reducing effect for the bit.

In another embodiment, a bit for drilling a wellbore includes: a body; and a cutting face. The cutting face includes: an inner section and an outer section; a plurality of blades protruding from the body, each blade extending from a center of the cutting face and across the outer section; and a row of superhard cutters mounted along each blade, each cutter mounted in a pocket formed adjacent to a leading edge of the blade and having a positive profile angle. At least one of the cutters is oriented at a positive side rake angle to create weight on bit (WOB) reducing effect relative to a hypothetical cutter oriented at a zero side rake angle. Each of the rest of the cutters are oriented at a side rake angle such that an overall effect of the side rake angles is the WOB reducing effect for the bit.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 4A illustrates the WOB reducing effect of the second and third drill bits. FIG. 4B illustrates a cutter layout of a fourth drill bit, according to another embodiment of the present disclosure. FIG. 4C illustrates the WOB reducing effect of the fourth drill bit.

FIG. 8A illustrates the WOB reducing effect of the bullet shaped drill bit. FIG. 8B illustrates a cutter layout of a second bullet shaped drill bit, according to another embodiment of the present disclosure. FIG. 8C illustrates the WOB reducing effect of the second bullet shaped drill bit.

DETAILED DESCRIPTION

Figure 1:
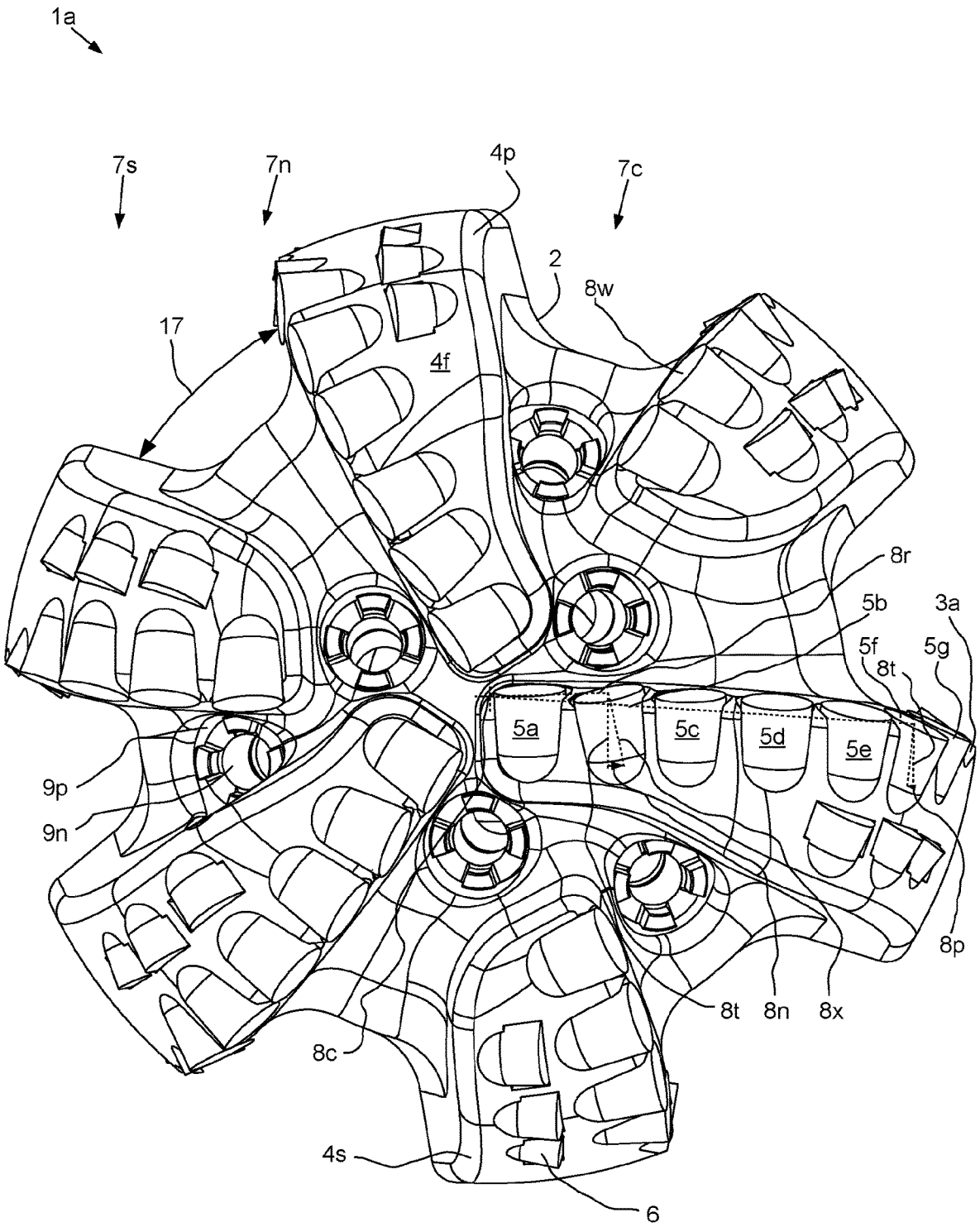
FIG. 1 illustrates a cutting face of a drill bit having a weight on bit (WOB) reducing effect, according to one embodiment of the present disclosure.

FIG. 1 illustrates a cutting face of a drill bit 1*a* having a weight on bit (WOB) reducing effect, according to one embodiment of the present disclosure. The drill bit 1*a* may include the cutting face, a bit body 2, a shank (not shown), and a gage section 3. A lower portion of the bit body 2 may be made from a composite material, such as a ceramic and/or cermet matrix powder infiltrated by a metallic binder, and an upper portion of the bit body may be made from a softer material than the composite material of the upper portion, such as a metal or alloy shoulder powder infiltrated by the metallic binder. The bit body 2 may be mounted to the shank during molding thereof. The shank may be tubular and made from a metal or alloy, such as steel, and have a coupling, such as a threaded pin, formed at an upper end thereof for connection of the drill bit 1*a* to a drill collar (not shown). The shank may have a flow bore formed therethrough and the flow bore may extend into the bit body 2 to a plenum (not shown) thereof. The cutting face may form a lower end of the drill bit 1*a* and the gage section 3 may form at an outer portion thereof.

Alternatively, the bit body 2 may be metallic, such as being made from steel, and may be hardfaced. The metallic bit body may be connected to a modified shank by threaded couplings and then secured by a weld or the metallic bit body may be monoblock having an integral body and shank.

Figure 2A:
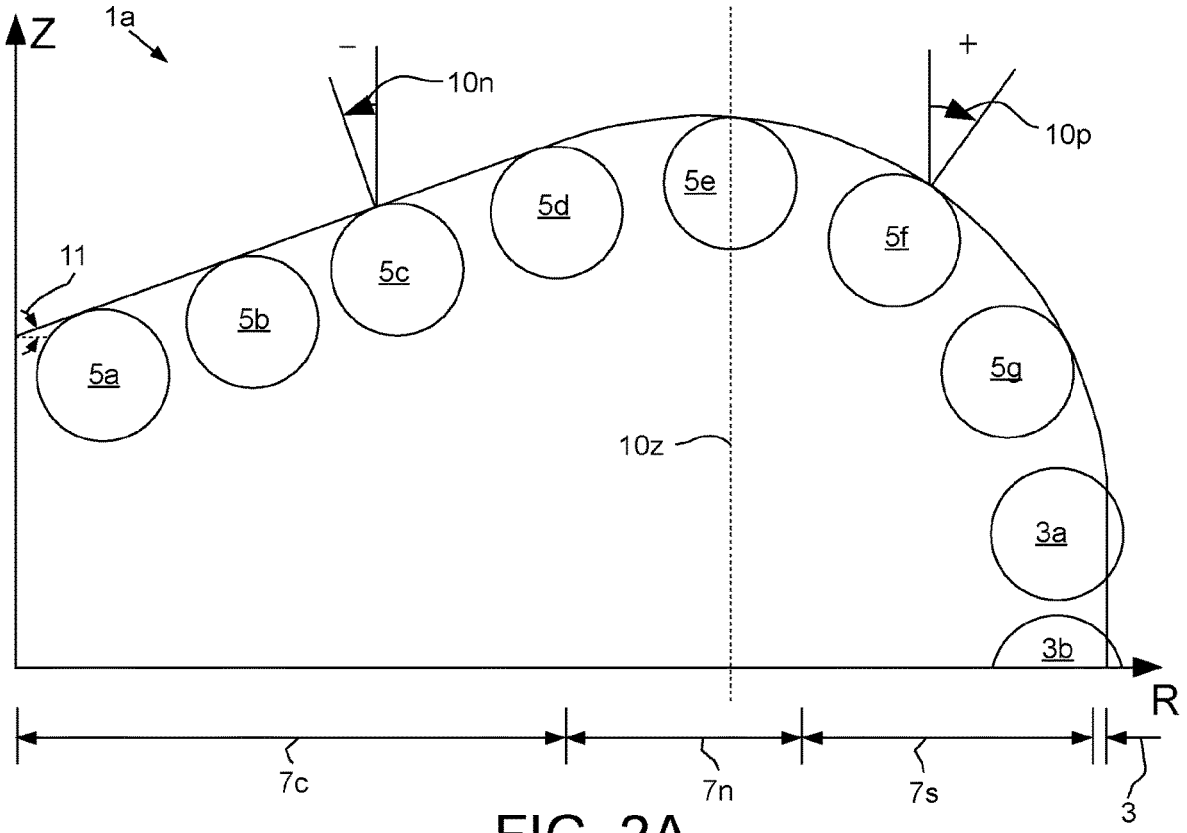
FIG. 2A illustrates a profile of the drill bit and a profile angle of cutters of the drill bit.

The cutting face may include one or more (three shown) primary blades 4*p*, one or more (three shown) secondary blades 4*s*, fluid courses 17 formed between the blades, a row of leading cutters 5*a-g* mounted along each blade, and backup cutters 6 mounted to each blade. The cutting face may have one or more sections, such as an inner cone 7*c*, an outer shoulder 7*s*, and an intermediate nose 7*n* between the cone and the shoulder sections. The blades 4*p,s* may be disposed around the cutting face and each blade may be formed during molding of the bit body 2 and may protrude from a bottom of the bit body. The primary blades 4*p* and the secondary blades 4*s* may be arranged about the cutting face in an alternating fashion. The primary blades 4*p* may each extend from a center 8*c* of the cutting face, across a portion of the cone section 7*c*, across the nose 7*n* and shoulder 7*s* sections, and to the gage section 3. The secondary blades 4*s* may each extend from a periphery of the cone section 7*c*, across the nose 7*n* and shoulder 7*s* sections, and to the gage section 3. Each blade 4*p,s* may extend generally radially across the portion of the cone section 7*c* (primary only) and nose section 7*n* with a slight spiral curvature and across the shoulder section 7*s* radially and longitudinally with a slight helical curvature. Each primary blade 4*p* may be inclined in the cone section 7*c* by a cone angle 11 (FIG. 2A). The cone angle 11 may range between five and forty-five degrees, such as twenty degrees.

Each blade 4*p,s* may be made from the same material as the lower portion of the bit body 2. The leading cutters 5*a-g* may be mounted along leading edges of the blades 4*p,s* after infiltration of the bit body 2. The leading cutters 5*a-g* may be pre-formed, such as by high pressure and temperature sintering, and mounted, such as by brazing, in respective leading pockets formed in the blades 4*p,s* adjacent to the leading edges thereof. Each blade 4*p,s* may have a lower face 4*f* extending between a leading edge and a trailing edge thereof.

Starting in the nose section 7*n* or shoulder section 7*s*, each blade 4*p,s* may have a row of backup pockets formed in the lower face 4*f* thereof and extending therealong. Each backup pocket may be aligned with or slightly offset from a respective leading pocket. The backup cutters 6 may be mounted, such as by brazing, in the backup pockets formed in the lower faces 4*f* of the blades 4*p,s*. The backup cutters 6 may be pre-formed, such as by high pressure and temperature sintering. The backup cutters 6 may extend along at least the shoulder section 7*s* of each blade 4*p,s*.

Alternatively, the drill bit 1*a* may further include shock studs protruding from the lower face 4*f* of each primary blade 4*p* in the cone section 7*c* and each shock stud may be aligned with or slightly offset from a respective leading cutter 5*a-g*.

One or more (six shown) ports 9*p* may be formed in the bit body 2 and each port may extend from the plenum and through the bottom of the bit body to discharge drilling fluid (not shown) along the fluid courses 17. A nozzle 9*n* may be disposed in each port 9*p* and fastened to the bit body 2. Each nozzle 9*n* may be fastened to the bit body 2 by having a threaded coupling formed in an outer surface thereof and each port 9*p* may be a threaded socket for engagement with the respective threaded coupling. The ports 9*p* may include an inner set of one or more (three shown) ports disposed in the cone section 7*c* and an outer set of one or more (three shown) ports disposed in the nose section 7*n* and/or shoulder section 7*s*. Each inner port 9*p* may be disposed between an inner end of a respective secondary blade 4*s* and the center 8*c* of the cutting face.

The gage section 3 may define a gage diameter of the drill bit 1*a*. The gage section 3 may include a plurality of gage pads (not shown), such as one gage pad for each blade 4*p,s*, a plurality of gage trimmers 3*a,b*, (3*b* shown in FIG. 2A) and junk slots formed between the gage pads. The junk slots may be in fluid communication with the fluid courses 17 formed between the blades 4*p,s*. The gage pads may be disposed around the gage section 3 and each pad may be formed during molding of the bit body 3 and may protrude from the outer portion of the bit body. Each gage pad may be made from the same material as the bit body 2 and each gage pad may be formed integrally with a respective blade 4*p,s*. Each gage pad may extend upward from a shoulder portion of the respective blade 4*p,s* to an exposed outer surface of the shank.

Each gage pad may have a rectangular lower portion and a tapered upper portion. The tapered upper portions may transition an outer diameter of the drill bit 1*a* from the gage diameter to a lesser diameter of the shank. A taper angle may be the same for each upper portion and may range between thirty and sixty degrees as measured from a transverse axis of the drill bit 1*a*. Each gage trimmer 3*a,b* may be mounted to a leading edge of each lower portion. The gage trimmers 3*a,b* may be mounted, such as by brazing, in respective pockets formed in the lower portions adjacent to the leading edges thereof. The rectangular lower portions may have flat outer surfaces (except for the pockets therein). The gage trimmers 3*a,b* may have flats formed in outer surfaces thereof so as not to extend past the gage diameter of the drill bit 1*a*.

Alternatively, the gage pads may have gage protectors embedded therein.

Each cutter 5*a-g*, 6 and gage trimmer 3*a,b* may be a shear cutter and include a superhard cutting table, such as polycrystalline diamond (PCD), attached to a hard substrate, such as a cermet, thereby forming a compact, such as a polycrystalline diamond compact (PDC). The cermet may be a carbide cemented by a Group VIIIB metal, such as cobalt. The substrate and the cutting table may each be solid and cylindrical and a diameter of the substrate may be equal to a diameter of the cutting table. A working face of each cutter 5*a-g*, 6 and gage trimmer 3*a,b* may be opposite to the substrate and may be smooth and planar. Each gage protector may be made from thermally stable PCD or PDC.

FIG. 2A illustrates a profile of the drill bit 1*a* and a profile angle 10*n,p* of cutters 5*a-g* of the drill bit. The bit profile is generated by projecting all of the cutters 5*a-g*, 6 and gage trimmers 3*a,b* of all of the blades 4*p,s* of the drill bit 1*a* onto a single plane and using a locus of the tips of the cutters and gage trimmers to generate a curve. For the sake of clarity, only the leading cutters 5*a-g* of one of the primary blades 4*p* is shown. Each cutter 5*a-g*, 6 may have a profile angle 10*n,p* relative to a longitudinal axis Z of the drill bit 1*a*. Each profile angle 10*n,p* may be measured from a line parallel to the longitudinal axis Z to a line normal to the bit profile at a location of the tip of the respective cutter 5*a-g*, 6 and gage trimmer 3*a,b*. Each normal line may extend from the tip of the respective cutter 5*a-g*, 6 or gage trimmer 3*a,b* and away from the respective blade 4*p,s* or gage pad. Each profile angle 10*n,p* may be positive in the clockwise direction and negative in the counter-clockwise direction. For each primary blade 4*p*, the cutters 5*a-d* have a negative profile angle 10*n*, the cutters 5*f,g* and gage trimmers 3*a,b* have a positive profile angle 10*p*, and the cutter 5*e* has a zero profile angle as indicated by the inflexion line 10*z*. Generally, the cutters 5*a-g*, 6 in the cone section 7*c* will have a negative profile angle 10*n* due to the cone angle 11 and the cutters in the shoulder region 7*s* will have a positive profile angle 10*p*. The cutters 5*a-g*, 6 in the nose region 7*n* can any of a positive profile angle 10*p*, a negative profile angle 10*n*, or a zero profile angle depending on the radial distance R from the center 8*c* of the cutting face.

One 5*b* of the leading cutters 5*a-g* of each primary blade 4*p* may be oriented at a negative side rake angle 8*n*. One 5*f* of the leading cutters 5*a-g* of each primary blade 4*p* may be oriented at a positive side rake angle 8*p*. The side rake angle 8*n,p* may be defined by an inclination of a through axis 8*x* of each cutter 5*a-g*, 6 relative to a respective line 8*t* tangent to a respective radial line 8*r* extending from the center 8*c* of the cutting face to a respective center of a working face 8*w* of the respective cutter about a respective inclination axis (not shown) normal to a respective projection (not shown) of the lower face 3*f* of the respective blade 3*p,s* at the center of the working face. In the view of FIG. 1, the polarity of the side rake angle 8*n* is negative for the counter-clockwise direction and positive 8*p* for the clockwise direction or negative if the working face 8*w* of the cutter 5*a-g*, 6 is tilted inward toward the center 8*c* of the cutting face and positive if the cutter is tilted outward away from the center of the cutting face.

The rest of the cutters 5*a*, 5*c-e*, 5*g*, 6 and gage trimmers 3*a,b* of the drill bit 1*a* may be oriented at a zero side rake angle. The one cutter 5*b* of each primary blade 4*p* having the negative side rake angle 8*n* may also have a negative profile angle 10*n* and the one cutter 5*f* of each primary blade having the positive side rake angle 8*p* may have a positive profile angle. An absolute value of the side rake angle 8*n,p* of the cutters 5*b,f* may range between five and thirty degrees.

Alternatively, most or all of the leading cutters 5*a-g* of each primary blade 4*p* having a negative profile angle 10*n* may have a negative side rake angle and most or all of the leading cutters 5*a-g* and gage trimmers 3*a,b* of each primary blade having a positive profile angle 10*p* may have a positive side rake angle. An absolute value of the side rake angles 8*n,p* of the cutters may range between five and thirty degrees. Generally, as discussed below, the leading cutters 5*a-g* and gage trimmers 3*a,b* of each primary blade 4*p* may be side raked according to a profile angle scheme where cutters having a negative profile angle 10*n* are oriented with a negative side rake angle 8*n* and cutters and trimmers having a positive profile angle 10*p* are oriented with a positive side rake angle. Most or all of the leading cutters and trimmers of the secondary blades 4*s* may also be side raked according to the profile angle scheme. The backup cutters 6 may also be side raked according to the profile angle scheme. Alternatively, the leading cutter 5*f* of each primary blade 4*p* may have a zero side rake angle. Alternatively, the leading cutter 5*b* of each primary blade 4*p* may have a zero side rake angle.

In use (not shown), the drill bit 1*a* may be assembled with one or more drill collars, such as by threaded couplings, thereby forming a bottomhole assembly (BHA). The BHA may be connected to a bottom of a pipe string, such as drill pipe or coiled tubing, thereby forming a drill string. The BHA may further include a steering tool, such as a bent sub or rotary steering tool, for drilling a deviated portion of the wellbore. The pipe string may be used to deploy the BHA into the wellbore. The drill bit 1*a* may be rotated, such as by rotation of the drill string from a rig (not shown) and/or by a drilling motor (not shown) of the BHA, while drilling fluid, such as mud, may be pumped down the drill string. A portion of the weight of the drill string may be set on the drill bit 1*a*. The drilling fluid may be discharged by the nozzles 9*n* and carry cuttings up an annulus formed between the drill string and the wellbore and/or between the drill string and a casing string and/or liner string.

Figure 2B:
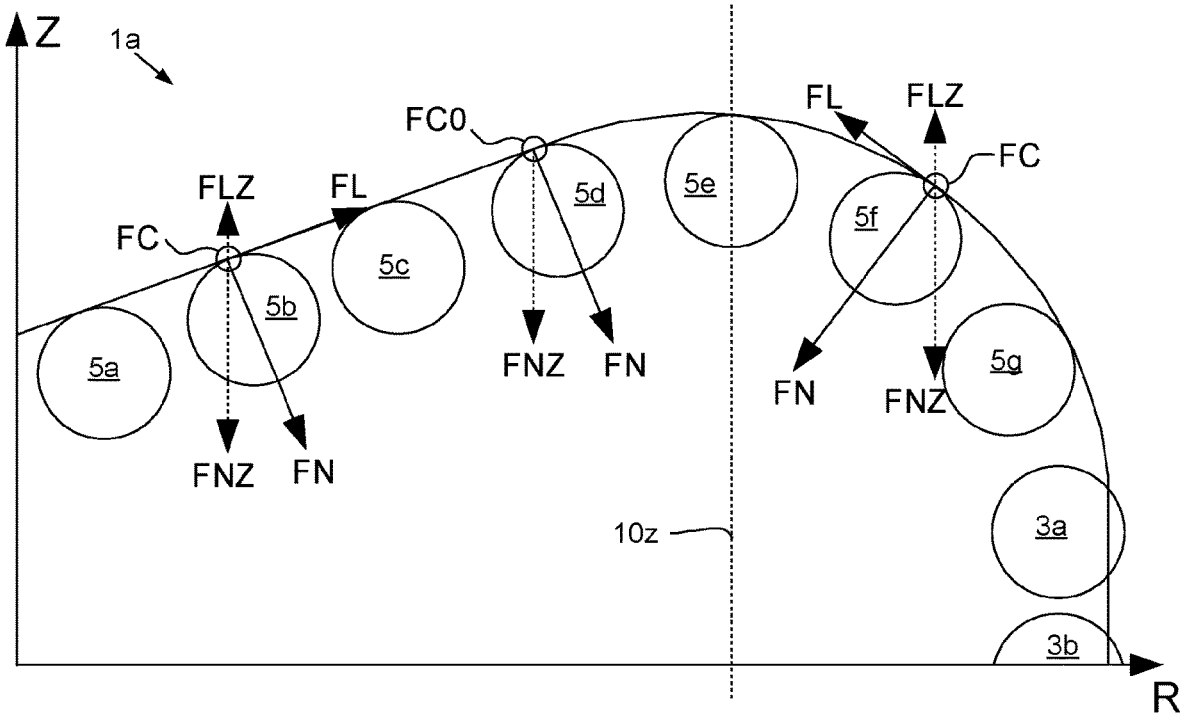
FIG. 2B illustrates the profile of the drill bit and forces exerted on the cutters.

FIG. 2B illustrates the profile of the drill bit 1*a* and forces exerted on the cutters 5*b,d,f*. The leading cutter 5*b* has a negative profile angle 10*n* and a negative side rake angle 8*n*. The leading cutter 5*f* has a positive profile angle 10*p* and a positive side rake angle. The leading cutter 5*d* has a zero side rake angle and the profile angle is not relevant for the cutter due to the zero side rake angle. In this Figure, the drill bit 1*a* is drilling along the longitudinal axis Z thereof.

For the leading cutter 5*d*, a cutting force FC0 is generated (perpendicular to the page) and a normal force FN is generated. A projection of the normal force along the longitudinal axis is shown as FNZ. The projected force FNZ opposes forward movement of the drill bit 1*a*. If the drill bit 1*a* had all zero side raked cutters, the WOB would be determined by summing (and inverting) the projected force FNZ for each cutter 5*a-g*, 6.

As has been demonstrated by SPE-151406-MS (discussed above), for cutters having an absolute value side rake angle less than about thirty degrees: the side rake angle has a negligible influence on the specific energy associated to the drilling process and the side rake has a negligible influence on the ratio between the normal force FN and the cutting force FC, FC0. Consequently, and within this limit of side rake angle, neither the cutting force FC, FC0 nor the normal force component FN will be impacted physically and explicitly by the side rake, except for changes in cutting sections. To illustrate, when applying the side rake angles 8*n,p*, it can be fairly assumed that: the normal force FN will remain more or less the same in comparison to its value at zero side rake (small decrease due to the decrease in cutting section). The cutting force FC, FC0 will remain more or less the same but the direction will change, such that the cutting force will have two components: FC=FC0*cos(8*n,p*); and FL=FC0*sin(8*n,p*). The component FC has the same tangential direction as the cutting force FC0 and the new lateral component FL has a direction along a surface of the blade 4*p*.

Assuming that an absolute value of the side rake angles 8*n,p* equals twenty degrees, then: the cutting section decreases only by a factor of (1−cos(20)=0.07); according to the literature, FC only decreases by this same factor (no decrease due to a loss in specific energy); according to the literature, FN only decreases by this same factor (no decrease due to a loss in specific energy); and the new lateral force FL has an amplitude of sin(20)=0.34*FC0. Thus, at a very limited expense in terms of cutting efficiency, a significant lateral force FL can be generated by adjustment of the side rake angle 8*n,p*. The polarity of the side rake angle 8*n,p* and the polarity of the profile angle 10*n,p* will dictate whether the lateral force FL acts as a resisting force (increasing the WOB) or as a driving force (reducing the WOB).

For each of the side raked cutters 5*b,f*, the projection FLZ of lateral force FL onto the longitudinal axis Z, opposes the projection FNZ of the normal force FN along the longitudinal axis Z. For the side raked cutters 5*b* in the cone section 7*c*, the projection FLZ is equal to FL*sin(cone angle 11). In other words, for each of the side raked cutters 5*b,f*, a driving force FLZ which goes in the same direction as the movement of the drill bit 1*a* is generated while drilling the rock. This driving force FLZ reduces the WOB, or in other words, has a reducing WOB effect. Thus, any cutter 5*a-g*, 6 having a negative profile angle 10*n* and a negative side rake angle 8*n* has a reducing WOB effect and any cutter and gage trimmer 3*a,b* having a positive profile angle 10*p* and a positive side rake angle 8*p* has a reducing WOB effect.

Figure 3A:
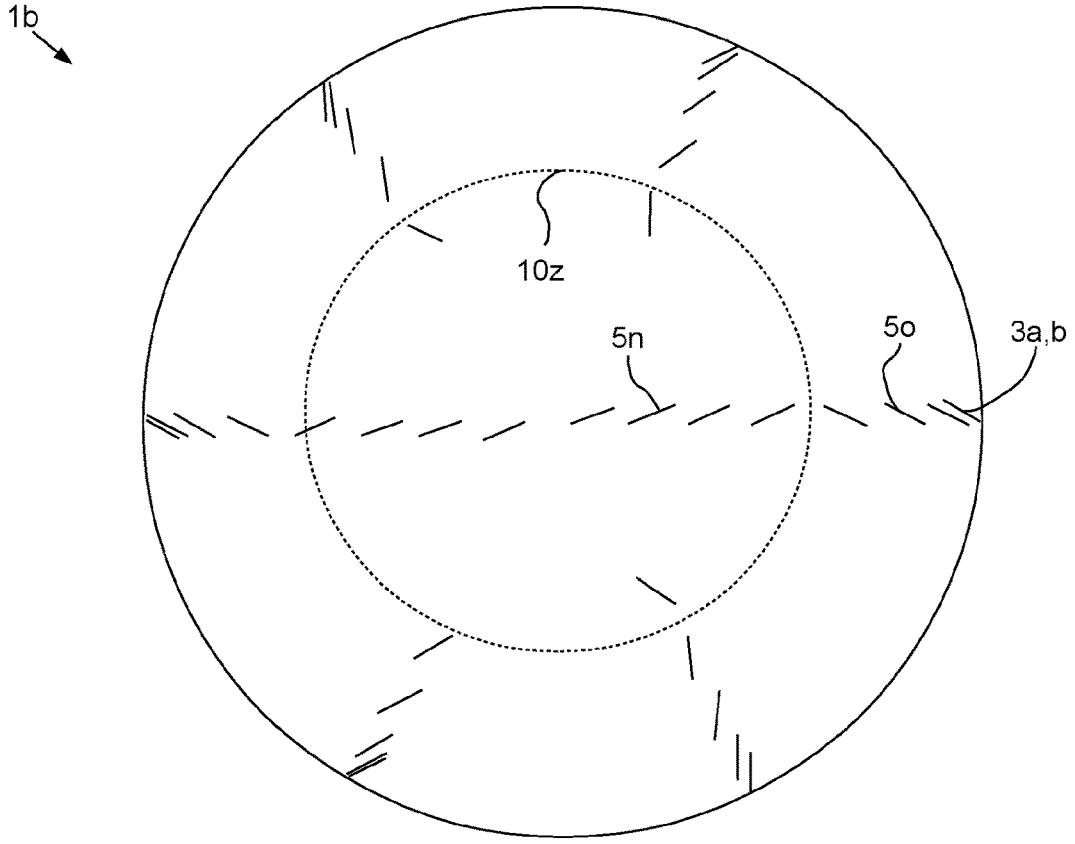
FIG. 3A illustrates the cutting face of a second drill bit having a weight on bit (WOB) reducing effect, according to another embodiment of the present disclosure.

FIG. 3A illustrates the cutting face of a second drill bit 1*b* having a weight on bit (WOB) reducing effect, according to another embodiment of the present disclosure. The second drill bit 1*b* may be similar to the (first) drill bit 1*a*, discussed above, except for: having two primary blades (may be inferred from cutter positions) instead of the three primary blades 4*p*, having four secondary blades (may be inferred from cutter positions) instead of the three secondary blades 4*s*, having no backup cutters instead of the backup cutters 6, having all inner leading cutters 5*n* oriented at a negative side rake angle 8*n*, such as minus twenty degrees, and having all outer leading cutters 5*o* and gage trimmers 3*a,b* oriented at a positive side rake angle 8*p*, such as twenty degrees. The inflexion circle 10*z* serves as the divider between the inner leading cutters 5*n* and the outer leading cutters 5*o*.

Figure 3B:
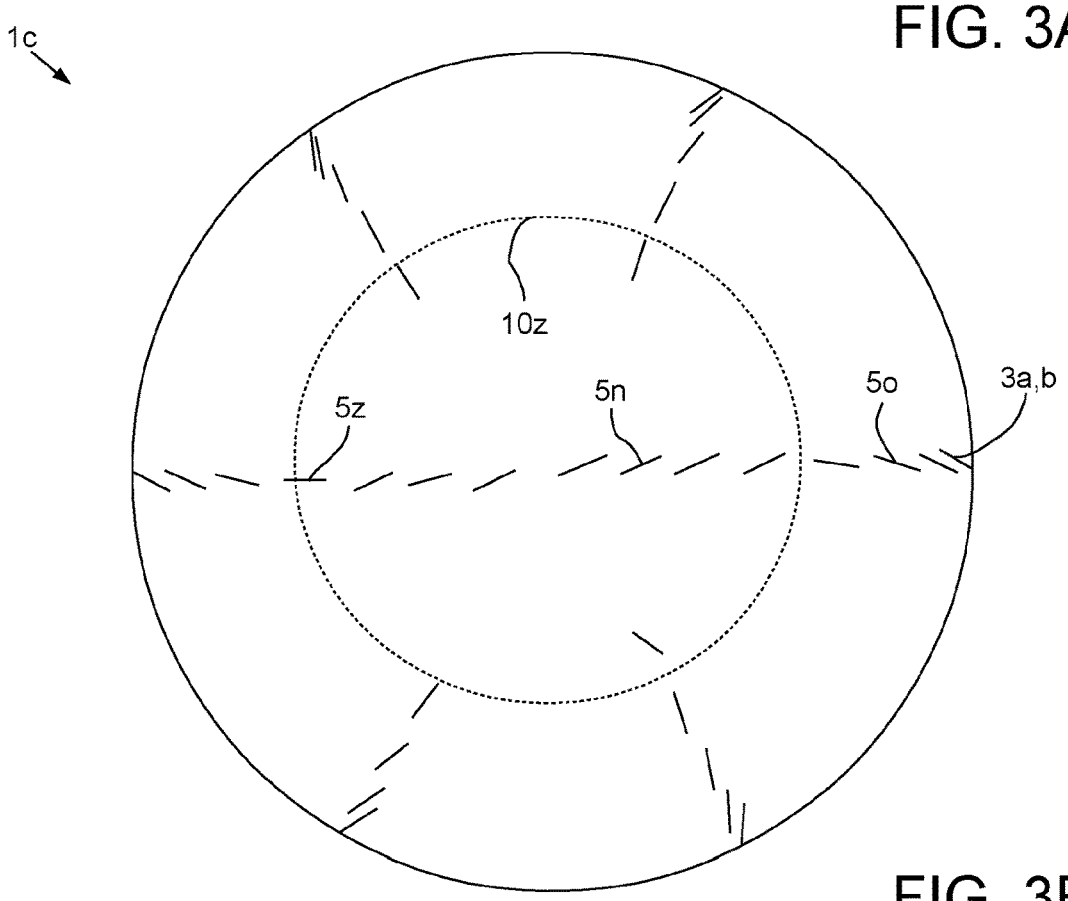
FIG. 3B illustrates the cutting face of a third drill bit having a WOB reducing effect, according to another embodiment of the present disclosure.

FIG. 3B illustrates the cutting face of a third drill bit 1*c* having a WOB reducing effect, according to another embodiment of the present disclosure. The third drill bit 1*c* may be similar to the second drill bit 1*b*, discussed above, except for: having a lesser cone angle 11, such as ten degrees, having the inner leading cutters 5*n* oriented with varying negative side rake angles 8*n* with an absolute value less than or equal to twenty degrees, having the outer leading cutters 5*o* and gage trimmers 3*a,b* oriented with varying positive side rake angles 8*p* with a value less than or equal to ten degrees, and having one leading cutter 5*z* at the inflexion circle 10*z* having a zero side rake angle.

FIG. 4A illustrates the WOB reducing effect of the second 1*b* and third 1*c* drill bits. The Reference drill bit may be similar to the third drill bit 1*c*, discussed above, except for: having a lesser cone angle 11, such as five degrees, and having all leading cutters oriented at a zero side rake angle. A drilling computer simulation was executed for each drill bit having the following parameters: bit depth of one thousand meters, mud density of one point one grams per cubic centimeter, rate of penetration of twenty-four meters per hour, rotation rate of two hundred revolutions per minute, uniaxial compressive strength of one hundred thirty-eight megapascals, internal friction angle of thirty degrees, cohesion of forty megapascals, and cutting friction angle of ten degrees.

The overall reduced WOB effect is clearly evident for the second 1*b* and third 1*c* drill bits. The overall reduced WOB effect is particularly significant (about a thirty percent reduction in WOB relative to the Reference drill bit) for the second drill bit 1*b* having the greater cone angle 11 (twenty degrees) and the greater side rake angles 8*n,p* (absolute value equaling twenty degrees). The reduced WOB effect may also be enhanced by a steep shoulder section 7*s*. Interestingly, changes in the side rake angles 8*n,p* do not affect the torque on bit (TOB) significantly. Thus, the WOB reducing effect is obtained at virtually no expense in terms of cutting efficiency.

FIG. 4B illustrates a cutter layout of a fourth drill bit 1*d*, according to another embodiment of the present disclosure. FIG. 4C illustrates the WOB reducing effect of the fourth drill bit 1*d*. Each of the fourth-eighth drill bits 1*d*-1*h* may be similar to the (first) drill bit 1*a*, discussed above, except for: having two primary blades instead of the three primary blades 4*p*, having no secondary blades instead of the three secondary blades 4*s*, having no backup cutters instead of the backup cutters 6, having no gage trimmers, and having the inner leading cutters 5*n* and outer leading cutters 5*o* oriented as shown in the respective figures. In FIGS. 4B-6D, the horizontal axis P shows the radial position of all of the leading cutters 5*n,o,z* regardless of which primary blade they are mounted to.

The fourth drill bit 1*d* has one inner leading cutter 5*n* oriented with a negative side rake angle 8*n* and the rest of the cutters 5*n,o,z* have zero side rake angles. The WOB reducing effect is illustrated by comparing the longitudinal force FZ for the one side raked cutter 5*n* with the longitudinal force FZ of the hypothetical cutter 5*x* (illustrated in phantom).

Figure 5A:
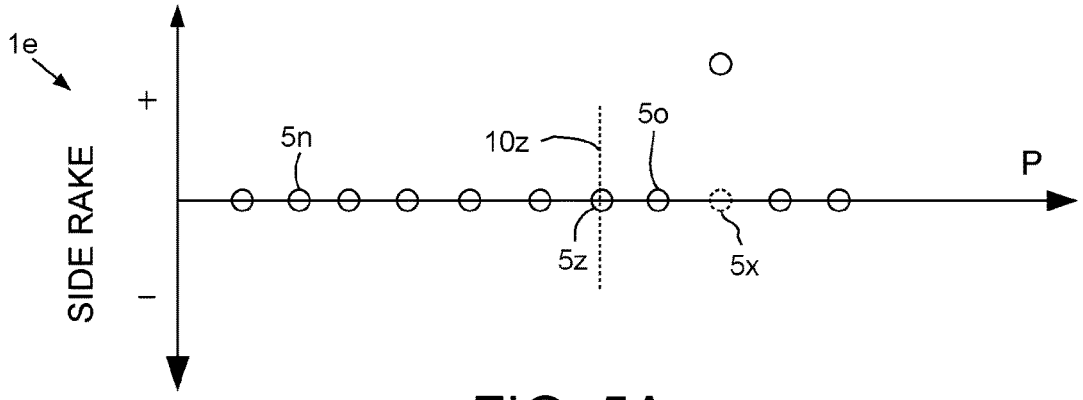
FIG. 5A illustrates a cutter layout of a fifth drill bit, according to another embodiment of the present disclosure.
Figure 5B:
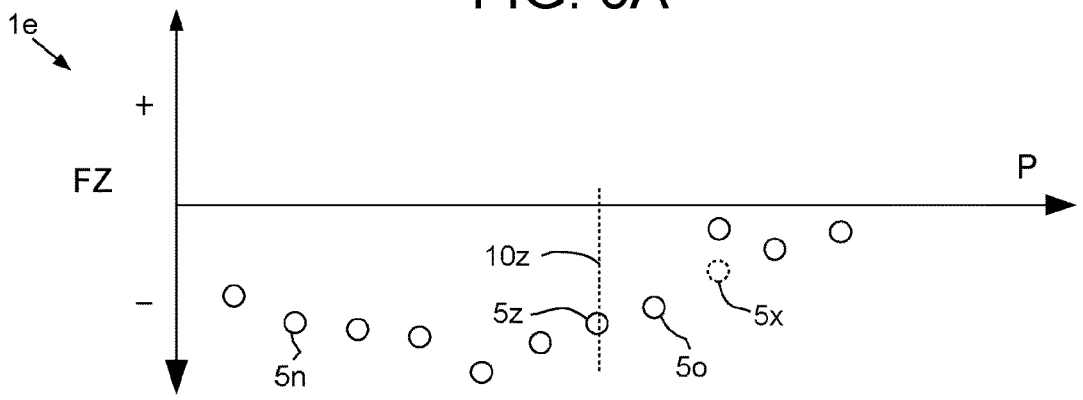
FIG. 5B illustrates the WOB reducing effect of the fifth drill bit.

FIG. 5A illustrates a cutter layout of a fifth drill bit 1*e*, according to another embodiment of the present disclosure. FIG. 5B illustrates the WOB reducing effect of the fifth drill bit 1*e*. The fifth drill bit 1*e* has one outer leading cutter 5*o* oriented with a positive side rake angle 8*p* and the rest of the cutters 5*n,o,z* have zero side rake angles. The WOB reducing effect is illustrated by comparing the longitudinal force FZ for the one side raked cutter 5*o* with the longitudinal force FZ of the hypothetical cutter 5*x*.

Figure 5C:
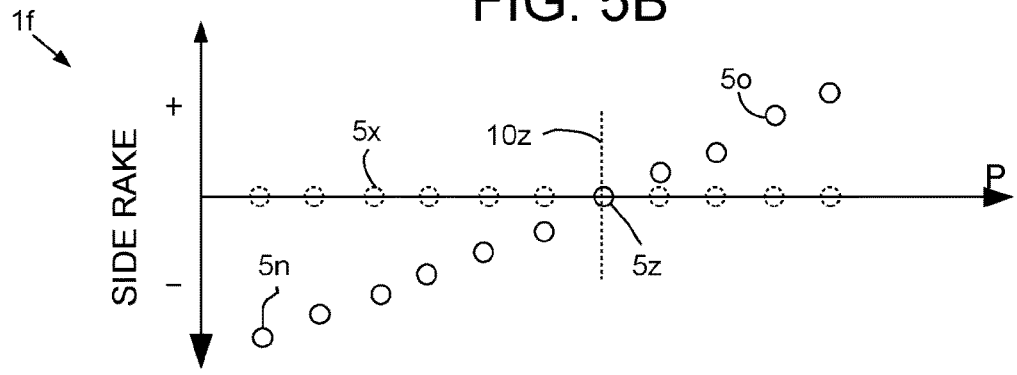
FIG. 5C illustrates a cutter layout of a sixth drill bit, according to another embodiment of the present disclosure.
Figure 5D:
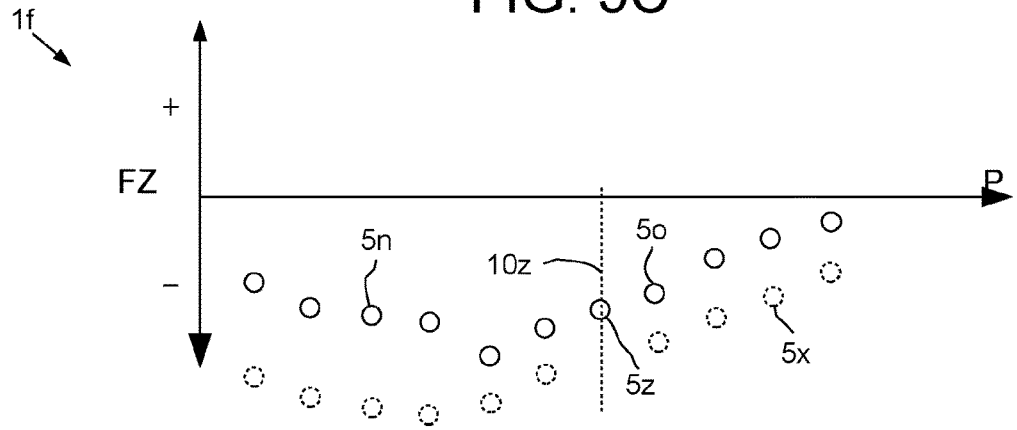
FIG. 5D illustrates the WOB reducing effect of the sixth drill bit.

FIG. 5C illustrates a cutter layout of a sixth drill bit 1*f*, according to another embodiment of the present disclosure. FIG. 5D illustrates the WOB reducing effect of the sixth drill bit 1*f*. The sixth drill bit 1*f* has the leading cutters 5*n,o,z* oriented with increasing side rake angles 8*n,p* from the cone section 7*c* to the shoulder section 7*s*, where the side rake angles are negative for the inner leading cutters 5*n* and positive for the outer leading cutters 5*o*. One leading cutter 5*z* at the inflexion line 10*z* has a zero side rake angle. The WOB reducing effect is illustrated by comparing the longitudinal forces FZ for the side raked cutters with the longitudinal forces FZ of the hypothetical cutters 5*x*.

Figure 6A:
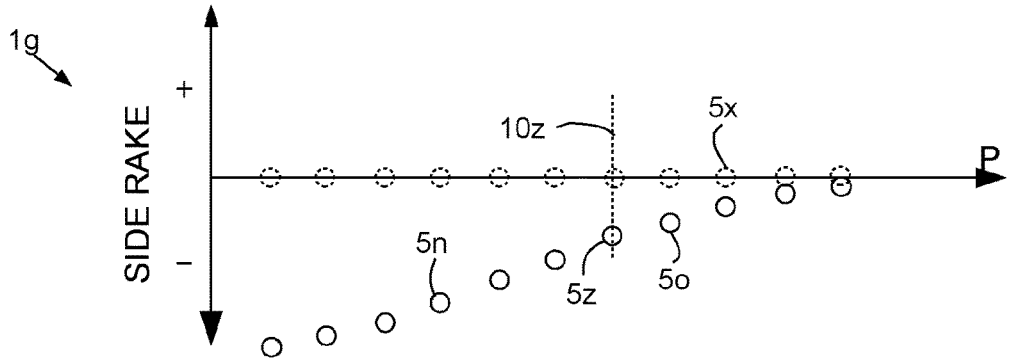
FIG. 6A illustrates a cutter layout of a seventh drill bit, according to another embodiment of the present disclosure.
Figure 6B:
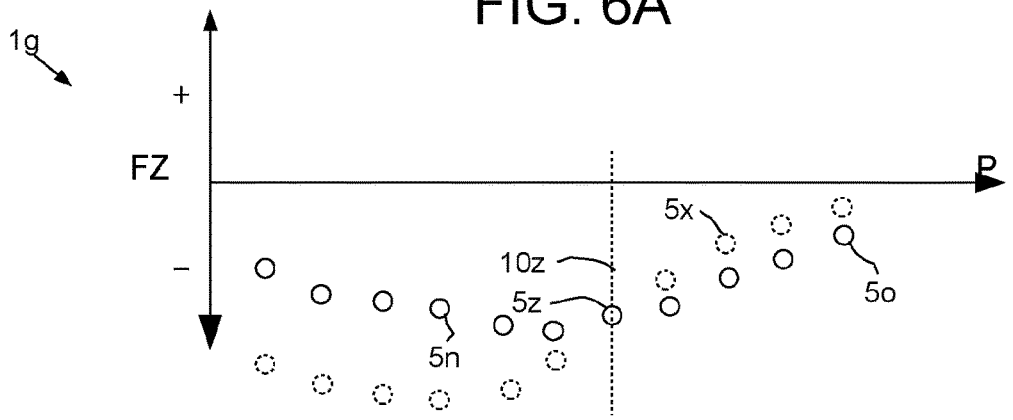
FIG. 6B illustrates the WOB reducing effect of the seventh drill bit.

FIG. 6A illustrates a cutter layout of a seventh drill bit 1*g*, according to another embodiment of the present disclosure. FIG. 6B illustrates the WOB reducing effect of the seventh drill bit 1*g*. The seventh drill bit 1*g* has the leading cutters 5*n,o,z* oriented with increasing negative side rake angles 8*n* from the cone section 7*c* to the shoulder section 7*s*. The WOB effect is illustrated by comparing the longitudinal forces FZ for the side raked cutters with the longitudinal forces FZ of the hypothetical cutters 5*x*. The inner cutters 5*n* have a WOB reducing effect while the outer cutters 5*o* have a WOB increasing effect; however, the overall effect is a WOB reducing effect.

Figure 6C:
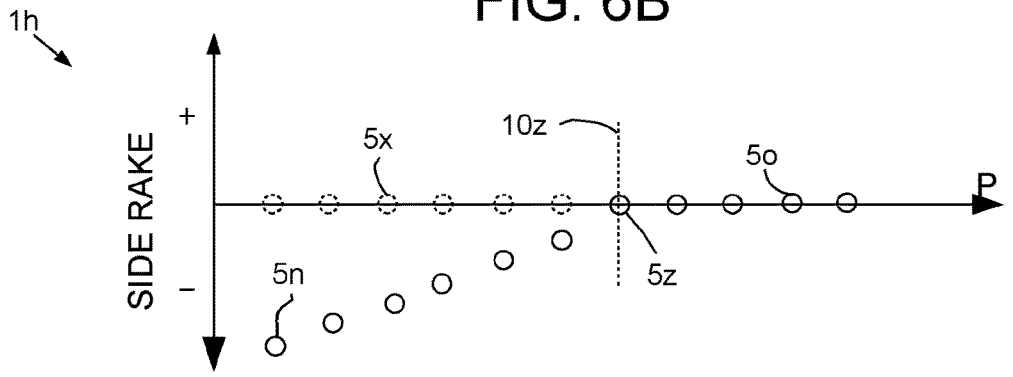
FIG. 6C illustrates a cutter layout of an eighth drill bit, according to another embodiment of the present disclosure.
Figure 6D:
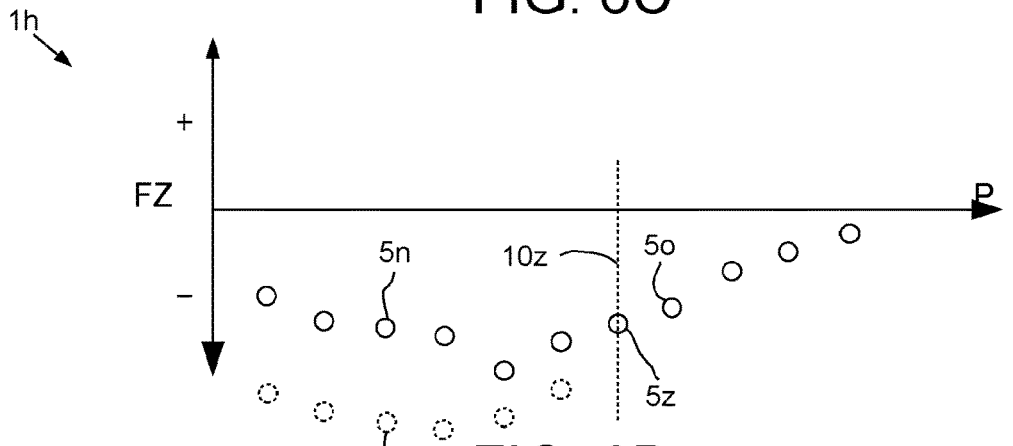
FIG. 6D illustrates the WOB reducing effect of the eighth drill bit.

FIG. 6C illustrates a cutter layout of an eighth drill bit 1*h*, according to another embodiment of the present disclosure. FIG. 6D illustrates the WOB reducing effect of the eighth drill bit 1*h*. The eighth drill bit 1*h* has the inner leading cutters 5*n* oriented with increasing negative side rake angles 8*n* from the cone section 7*c* to the nose section 7*n* and zero side rake angles for the rest of the leading cutters 5*o,z*. One leading cutter 5*z* at the inflexion line 10*z* has a zero side rake angle. The WOB reducing effect is illustrated by comparing the longitudinal forces FZ for the side raked cutters with the longitudinal forces FZ of the hypothetical cutters 5*x*.

Figure 7A:
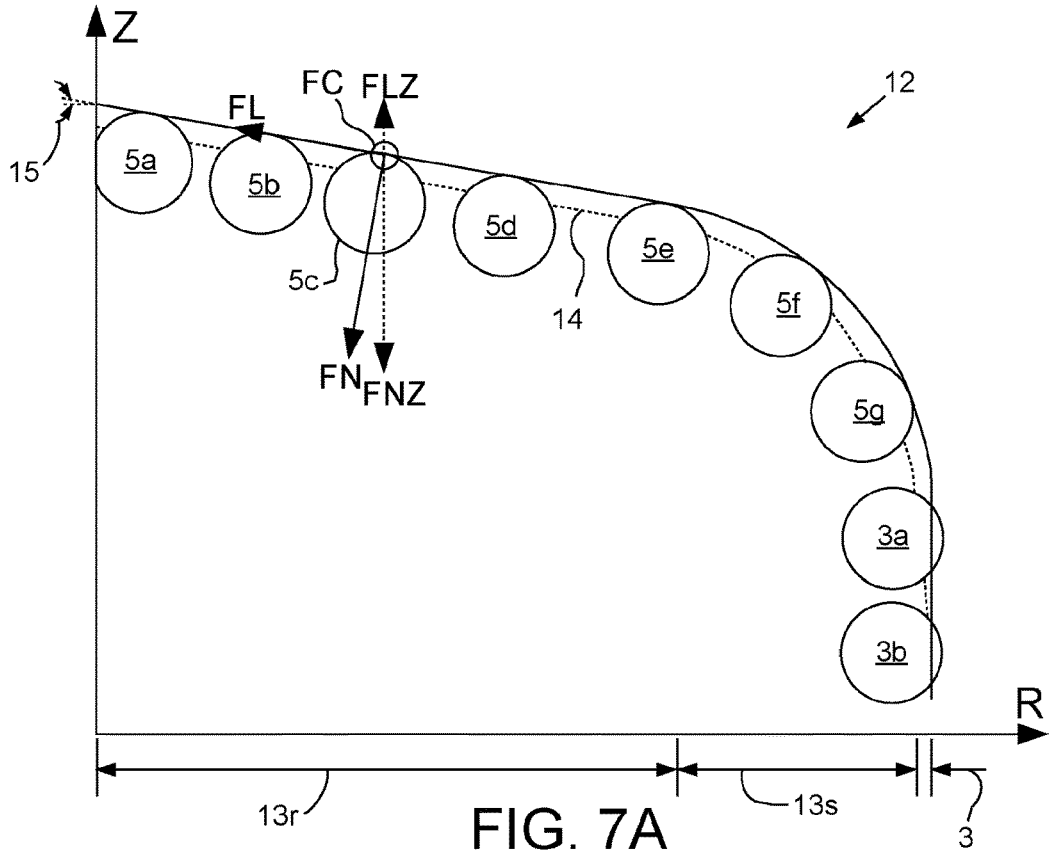
FIG. 7A illustrates a profile of a bullet shaped drill bit and forces exerted on the cutters, according to another embodiment of the present invention.
Figure 7B:
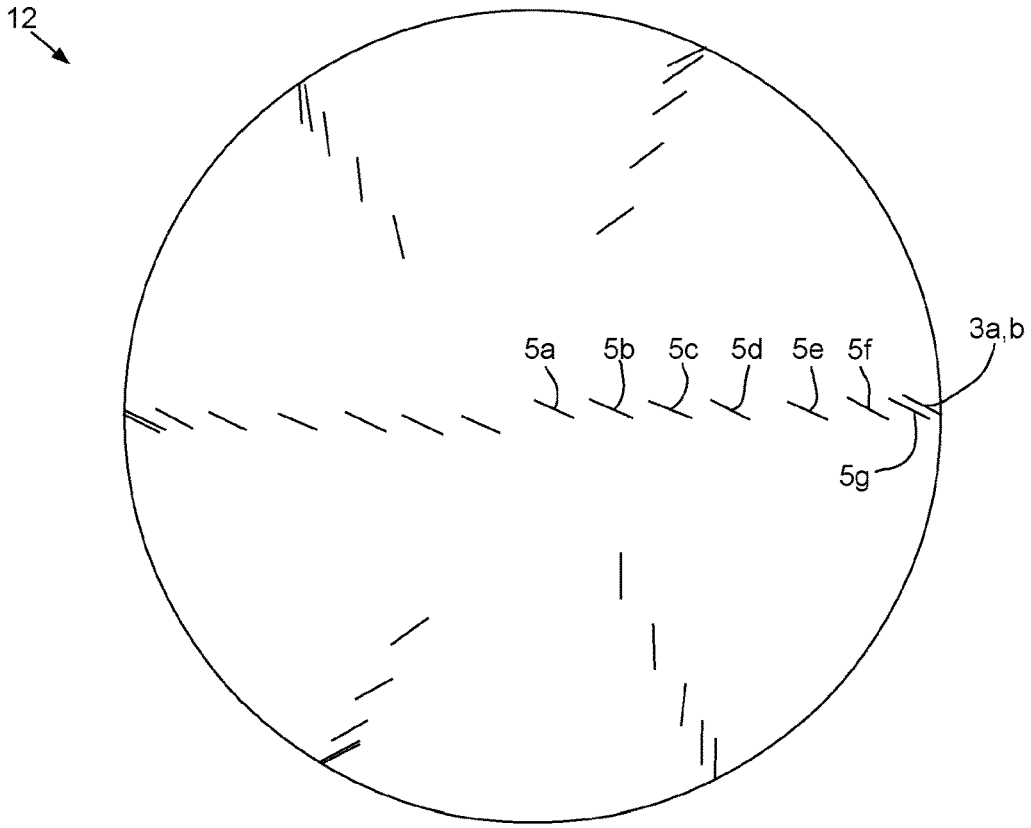
FIG. 7B illustrates the cutting face of the bullet shaped drill bit having a weight on bit (WOB) reducing effect.

FIG. 7A illustrates a profile of a bullet shaped drill bit 12 and forces exerted on the cutters, according to another embodiment of the present invention. FIG. 7B illustrates the cutting face of the bullet shaped drill bit having a weight on bit (WOB) reducing effect. The bullet shaped drill bit 12 may include the cutting face, a bit body (not shown), a shank (not shown), and the gage section 3. The shank may be similar to the shank of the drill bit 1*a*, discussed above. The bit body may be made from any of the materials discussed above for the bit body 2. The bit body may have a hemispherical or dome shaped lower end. The cutting face may form a lower end of the bullet shaped drill bit 12 and the gage section 3 may form an outer portion thereof.

The cutting face may include one or more, such as two (one shown and two may be inferred from cutter positions) primary blades 14, one or more, such as four (may be inferred from cutter positions) secondary blades, fluid courses formed between the blades, and the row of leading cutters 5*a-g* mounted along each blade. The cutting face may have one or more sections, such as an inner ridge 13*r* and an outer shoulder 13*s*. The blades 14 may be disposed around the cutting face and each blade may be formed during molding of the bit body and may protrude from a bottom of the bit body. The primary blades 14 may oppose each other and the secondary blades may be arranged about the cutting face between the primary blades. The primary blades 14 may each extend from a center of the cutting face, across a portion of the ridge section 13*r*, across the shoulder section 7*s*, and to the gage section 3. The secondary blades may each extend from a periphery of the ridge section 13*r*, across the shoulder section 7*s*, and to the gage section 3. Each blade 14 may extend generally radially across the portion of the ridge section 13*r* (primary only) with a slight spiral curvature and across the shoulder section 13*s* radially and longitudinally with a slight helical curvature. Each primary blade 14 may be declined in the ridge section 13*r* by a ridge angle 15. The ridge angle 15 may range between five and forty-five degrees, such as ten degrees.

Each blade 14 may be made from the same material as the lower portion of the bit body. The leading cutters 5*a-g* may be mounted along leading edges of the blades 14 after infiltration of the bit body. The leading cutters 5*a-g* may be pre-formed, such as by high pressure and temperature sintering, and mounted, such as by brazing, in respective leading pockets formed in the blades 14 adjacent to the leading edges thereof. Each blade 14 may have a lower face extending between a leading edge and a trailing edge thereof.

Alternatively, starting in the shoulder section 13*s*, each blade 14 may have a row of backup pockets formed in the lower face 4*f* thereof and extending therealong. Each backup pocket may be aligned with or slightly offset from a respective leading pocket. Backup cutters may be mounted, such as by brazing, in the backup pockets formed in the lower faces of the blades. The backup cutters may be pre-formed, such as by high pressure and temperature sintering. The backup cutters may extend along at least the shoulder section 13*s* of each blade 14. Alternatively, the bullet shaped drill bit 12 may further include shock studs protruding from the lower face of each primary blade 14 in the ridge section 13*r* and each shock stud may be aligned with or slightly offset from a respective leading cutter 5*a-g*.

One or more, such as four, ports (not shown) may be formed in the bit body and each port may extend from the plenum and through the bottom of the bit body to discharge drilling fluid (not shown) along the fluid courses. A nozzle may be disposed in each port and fastened to the bit body. Each nozzle may be fastened to the bit body by having a threaded coupling formed in an outer surface thereof and each port may be a threaded socket for engagement with the respective threaded coupling. The ports may include an inner set of one or more ports disposed in the ridge section 13*r* and an outer set of one or more ports disposed at the periphery of the ridge section 13*r* or shoulder section 13*s*. Each inner port may be disposed between an inner end of a respective secondary blade and the center of the cutting face.

All of the cutters 5*a-g* in the ridge 13*r* and shoulder 13*s* sections and the gage trimmers 3*a,b* have a positive profile angle 10*p* due to the ridge angle 15. Accordingly, all of the leading cutters 5*a-g* and gage trimmers 3*a,b* of each primary blade 14 and each secondary blade may be oriented at the positive side rake angle 8*p*, such as twenty degrees, to achieve the WOB reducing effect, as discussed above for the leading cutter 5*f*.

Alternatively, some of the leading cutters 5*a-g* and gage trimmers 3*a,b* of each primary blade 14 and/or secondary blade may have a zero side rake angle such that most of the leading cutters and gage trimmers still have the positive side rake angle 8*p*.

FIG. 8A illustrates the WOB reducing effect of the bullet shaped drill bit 12. The Reference drill bit may be similar to the bullet shaped drill bit 12, discussed above, except for having all leading cutters and gage trimmers oriented at a zero side rake angle. A drilling computer simulation was executed for each drill bit having the same parameters as the simulation, discussed above, of the second 1*b* and third 1*c* drill bits. The overall reduced WOB effect is clearly evident for the bullet shaped drill bit 12 (about a twenty percent reduction in WOB relative to the Reference drill bit). The reduced WOB effect may also be enhanced by a steep shoulder section 13*s*. Interestingly, changes in the side rake angles 8*n,p* do not affect the torque on bit (TOB) significantly. Thus, the WOB reducing effect is obtained at virtually no expense in terms of cutting efficiency.

FIG. 8B illustrates a cutter layout of a second bullet shaped drill bit 16, according to another embodiment of the present disclosure. FIG. 8C illustrates the WOB reducing effect of the second bullet shaped drill bit 16. The second bullet shaped drill bit 16 may be similar to the (first) bullet shaped drill bit 12, discussed above, except for: having no secondary blades instead of the four secondary blades, having no gage trimmers, and having the leading cutters 5 oriented as shown. In FIGS. 4B-6D, the horizontal axis P shows the radial position of all of the leading cutters 5 regardless of which primary blade they are mounted to.

The second bullet shaped drill bit 16 has one inner leading cutter 5 oriented with a positive side rake angle 8*p* and the rest of the cutters have zero side rake angles. The WOB reducing effect is illustrated by comparing the longitudinal force FZ for the one side raked cutter 5 with the longitudinal force FZ of the hypothetical cutter 5*x* (illustrated in phantom).

Advantageously, reducing the WOB required to drill a given wellbore reduces the risk of dysfunction of the drill string, such as buckling and/or vibration, while drilling. The WOB reducing effect may be especially beneficial for directional drilling where transmission of weight to the drill bit becomes challenging and serves as a limitation factor of drill bit performance. Further, the reduced WOB may lead to an increase in cutting efficiency due to reduced friction between the drill bit and the formation.

Alternatively, the absolute value of the side rake angles may be increased to a value greater than thirty degrees, such as ranging between thirty-one and forty-five degrees. This expanded range would be accompanied by a penalty in cutting efficiency. However, the increased WOB reducing effect may be worth the penalty, especially for certain directional drilling applications.

While the foregoing is directed to embodiments of the present disclosure, other and further embodiments of the disclosure may be devised without departing from the basic scope thereof, and the scope of the invention is determined by the claims that follow.

The invention claimed is:

1. A bit for drilling a wellbore, comprising:

a body; and a cutting face comprising:

an inner section and an outer section;

a plurality of blades protruding from the body, each blade extending from a center of the cutting face and across the outer section; and a row of superhard cutters mounted along each blade, each cutter mounted in a pocket formed adjacent to a leading edge of the blade, inner cutters in the inner section having a negative profile angle and outer cutters in the outer section having a positive profile angle, wherein:

most of the inner cutters are oriented at a negative side rake angle to create a weight on bit (WOB) reducing effect relative to a hypothetical cutter oriented at a zero side rake angle, each of the rest of the inner cutters are oriented at a side rake angle of about or less than zero and all of the outer cutters are oriented at a side rake angle of about or greater than zero such that an overall effect of the side rake angles is the WOB reducing effect for the bit, and the inner cutters that are oriented at the negative side rake angle are all shear cutters.

2. The bit of claim 1, wherein all of the inner cutters of each blade are oriented at the negative side rake angle.

3. The bit of claim 1, wherein at least one outer cutter of each blade is oriented at a positive side rake angle.

4. The bit of claim 1, wherein most of the outer cutters are oriented at the positive side rake angle.

5. The bit of claim 1, wherein all of the outer cutters of each blade are oriented at the positive side rake angle.

6. The bit of claim 1, wherein:

each blade includes a gage trimmer in the outer section, and the gage trimmer is oriented at the positive side rake angle to create the WOB reducing effect.

7. The bit of claim 1, wherein an absolute value of the side rake angle ranges between 5 and 30 degrees.

8. The bit of claim 1, wherein:

the inner section is a cone section, each blade is a primary blade, the cutting face further comprises a secondary blade protruding from the body and extending from a periphery of the cone section and a row of superhard cutters mounted to a leading edge of the secondary blade, and each outer cutter of the row of the secondary blade is oriented at a positive side rake angle.

9. The bit of claim 1, wherein:

all of the cutters of each blade having the negative profile angle are oriented at a negative side rake angle, and all of the cutters of each blade having the positive profile angle are oriented at a positive side rake angle.

10. The bit of claim 1, wherein:

the inner section is a cone section, the outer section is a shoulder section, the cutting face further comprises a nose section between the cone section and the shoulder section, and at least one of the cutters in the nose section is oriented at a zero side rake angle.

11. The bit of claim 1, wherein all of the cutters are shear cutters.

12. A bit for drilling a wellbore, comprising:

a body; and a cutting face comprising:

an inner section and an outer section;

a plurality of blades protruding from the body, each blade extending from a center of the cutting face and across the outer section; and a row of superhard cutters mounted along each blade, each cutter mounted in a pocket formed adjacent to a leading edge of the blade and having a positive profile angle, wherein:

most of the cutters are oriented at a positive side rake angle to create weight on bit (WOB) reducing effect relative to a hypothetical cutter oriented at a zero side rake angle, each of the rest of the cutters are oriented at a side rake angle of about or greater than zero such that an overall effect of the side rake angles is the WOB reducing effect for the bit, and the bit is bullet shaped.

13. The bit of claim 12, wherein all of the cutters are oriented at the positive side rake angle.

14. The bit of claim 12, wherein all of the cutters are shear cutters.

15. A bit for drilling a wellbore, comprising:

a body; and a cutting face comprising:

an inner section and an outer section;

a plurality of blades protruding from the body, each blade extending from a center of the cutting face and across the outer section; and a row of superhard cutters mounted along each blade, each cutter mounted in a pocket formed adjacent to a leading edge of the blade, inner cutters in the inner section having a negative profile angle and outer cutters in the outer section having a positive profile angle, wherein:

most of the outer cutters are oriented at a positive side rake angle to create a WOB reducing effect relative to a hypothetical cutter oriented at a zero side rake angle, each of the rest of the outer cutters are oriented at a side rake angle of about or greater than zero and all of the inner cutters are oriented at a side rake angle of about or less than zero such that an overall effect of the side rake angles is the WOB reducing effect for the bit, and all of the outer cutters are shear cutters.

16. The bit of claim 15, wherein all of the outer cutters of each blade are oriented at the positive side rake angle.

17. The bit of claim 15, wherein:

each blade includes a gage trimmer in the outer section, and the gage trimmer is oriented at the positive side rake angle to create the WOB reducing effect.

18. The bit of claim 15, wherein an absolute value of the side rake angle ranges between 5 and 30 degrees.

19. The bit of claim 15, wherein all of the cutters are shear cutters.

* * * * *